US007718116B2

(12) United States Patent
Geiman

(10) Patent No.: US 7,718,116 B2
(45) Date of Patent: May 18, 2010

(54) FORGED CARBURIZED POWDER METAL PART AND METHOD

(75) Inventor: Timothy E. Geiman, South Lyon, MI (US)

(73) Assignee: GKN Sinter Metals, Inc., Auburn Hills, MI (US)

( * ) Notice: Subject to any disclaimer, the term of this patent is extended or adjusted under 35 U.S.C. 154(b) by 498 days.

(21) Appl. No.: 11/277,392

(22) Filed: Mar. 24, 2006

(65) Prior Publication Data

US 2007/0224075 A1 Sep. 27, 2007

(51) Int. Cl.
*C22C 1/05* (2006.01)

(52) U.S. Cl. ..... 419/14; 419/26; 419/28; 419/38; 419/45; 419/57; 148/316; 148/210; 148/211

(58) Field of Classification Search ..... 419/28, 419/11, 14

See application file for complete search history.

(56) References Cited

U.S. PATENT DOCUMENTS

| | | | | | |
|---|---|---|---|---|---|
| 2,192,434 | A * | 3/1940 | Critchfield | ..... | 29/511 |
| 2,520,334 | A * | 8/1950 | Peters | ..... | 148/213 |
| 3,180,765 | A * | 4/1965 | Townsend et al. | ..... | 148/214 |
| 3,992,763 | A | 11/1976 | Haynie et al. | | |
| 4,002,471 | A | 1/1977 | Sarnes et al. | | |
| 4,165,243 | A | 8/1979 | Sarnes et al. | | |
| 4,629,518 | A * | 12/1986 | Larsen | ..... | 148/206 |
| 5,100,483 | A * | 3/1992 | Rhoads | ..... | 148/226 |
| 5,390,414 | A * | 2/1995 | Lisowsky | ..... | 29/893.34 |
| 2004/0219051 | A1 | 11/2004 | Sonti et al. | | |
| 2005/0133120 | A1 * | 6/2005 | Walenta et al. | ..... | 148/233 |

FOREIGN PATENT DOCUMENTS

| | | | |
|---|---|---|---|
| DE | 1170149 | B | 5/1964 |
| GB | 2035197 | A | 6/1980 |
| WO | 03095128 | A | 11/2003 |

* cited by examiner

*Primary Examiner*—Roy King
*Assistant Examiner*—Christopher Kessler
(74) *Attorney, Agent, or Firm*—Quarles & Brady LLP

(57) ABSTRACT

A method for obtaining a selectively non-carburized powdered metal part. The steps include compacting, sintering, removing, forging and cooling. A metal powder is compacted to form a preform having at least one first surface in which a forged part is required to have a case depth and at least one second surface in which a carburized portion is required to be removed prior to forging. The preform is then sintered and carburized. After carburizing the at least one second surface of the preform is removed and subsequently forged and cooled. The forged part has at least one second surface having improved post forging properties and at least one first surface having improved performance features. A part made from the present method is also provided.

17 Claims, 5 Drawing Sheets

FORGED CARBURIZED POWDER METAL PART AND METHOD

CROSS-REFERENCE TO RELATED APPLICATIONS

The present invention is related to application Ser. No. 11/277,388 entitled "Variable Case Depth Powder Metal Gear and Method Thereof" filed simultaneously herewith and incorporated by reference herein.

TECHNICAL FIELD

The invention relates to a forged powder metal part and more particularly to a selectively non-carburized powdered metal part, including a method.

BACKGROUND OF THE INVENTION

There is continuing demand for manufacturing processes that may lessen the cost, time or steps in producing a part. More often than not, the benefits resultantly associated with improving the manufacturing process are necessitated in the first instance by customer requirements to develop and improve products to have superior dimensional, mechanical and/or performance properties. For instances a typical differential side gear may have any or all of the following performance requirements such as: the spline area requiring dimensional precision, high shear strength and brinnelling resistance; the hub and thrust faces requiring dimensional precision, surface finish and case compatibility; the gear geometry requiring dimensional precision, surface finish and optimised profile; and the tooth and core strength may require impact resistance, wear resistance, spalling resistance, and different surface and core metallurgies. Different non-compatible manufacturing processes, i.e. casting, steel forging or powder metal forging, obtain different performance requirements for the same part, advantageously or otherwise.

Referring to FIG. 1, in order to meet some of these performance requirements, a gear 10 is made by forging a powder metal 14 and then case carburizing the gear to achieve a nearly constant effective case depth 16. The constant effective case depth 16 for each gear tooth 12 is shown in the partial cross-sectional view of FIG. 1. The parameters to be controlled to achieve nearly constant carburization of a fully dense part of specific hardness, case depth and carbon gradient are generally known. However, a nearly constant case depth does not necessarily achieve desired mechanical or machining properties desired in a post forged product. It would be advantageous to achieve a better-controlled balance of these performance requirements in the final product, uncompromised by the manufacturing process thereby saving time, processing or cost.

A manufacturing process to improve the performance requirements of powder metal parts in a process known as "sint-carb" is disclosed in U.S. Pat. No. 3,992,763 titled "Method of Making Powdered Metal Parts." The process teaches carburization during or subsequent to sintering, and prior to forging, to enhance the case depth at a critical wall of the final forged product, eliminating the need for subsequent heat treating processes for achieving a case hardness. U.S. Pat. No. 4,002,471 titled "Method of Making a Through-Hardened Scale-Free Forged Powdered Metal Article Without Heat Treatment After Forging", discloses a method of making forged powder iron base metal articles of high Rc hardness without need for further machining, surface treatment or heat treatment after quenching.

Also, U.S. Pat. No. 4,165,243 titled "Method of Making Selectively Carburized Forged Powder Metal Parts" discloses a process requiring additional steps of masking a part before sintering and removal of the masking after carburizing and before forging to obtain selected carburized surfaces on the part.

However, the above mentioned patents do not teach or suggest any processes in which removal of a carburized surface prior to forging may be used to achieve specific material requirements in a final forged product while providing improved dimensional precision, performance features or improved manufacturing of both carburized and noncarburized surfaces of the part. Moreover, the above mentioned patents do not teach or suggest the strategic and uncomplicated control afforded by a removal process.

Therefore, there is a need for a manufacturing process for removal of a carburized surface of a part prior to forging thereby leaving select carburized and noncarburized surfaces in the final forged part. Moreover, there is a need for a process that strategically removes a carburized portion of a part prior to forging and quenching thereby permitting improved post-forging operations upon the noncarburized portion of the part such that tighter tolerances, improved spline classification or improved shear resistance properties may be achieved while maintaining the beneficial forged carburized portion of the part. There is also a need for a part having improved dimensional precision or performance features.

SUMMARY OF THE INVENTION

In accordance with the above-mentioned needs, a gear and a manufacturing method for removal of a carburized surface of a part prior to forging leaving a select carburized surface having improved performance features and a select non-carburized surface having improved post forging properties for improved tolerance and classification is provided.

Specifically, a method for obtaining a selectively non-carburized powder metal part is provided. The method includes compacting, sintering, removing, forging and cooling. A metal powder is compacted to form a preform having at least one first surface portion in which a forged part is required to have a case hardness depth and at least one second surface portion in which a carburized portion is required to be removed prior to forging. The preform is then sintered and carburized. After carburizing the at least one second surface portion of the preform is removed and subsequently forged and cooled. The forged part has at least one second surface portion having improved shear resistance properties and at least one first surface having surface hardness properties.

A part made from the present method is also provided. The part includes a noncarburized portion in which post forging operation may be accomplished with less machining expense or time, while providing for improved tolerancing or dimensional control due to the nature of the softer noncarburized material portion. The part also includes a carburized portion having the beneficial attributes such as improved wear resistance, load bearing, impact resistance or bending fatigue resultantly obtained by the near net-shaped finished sint-carb forging manufacturing process.

BRIEF DESCRIPTION OF THE DRAWINGS

For a more complete understanding of this invention, reference should now be made to the inventive aspects illustrated in greater detail in the accompanying drawings and described below.

DETAILED DESCRIPTION

Figure 1:
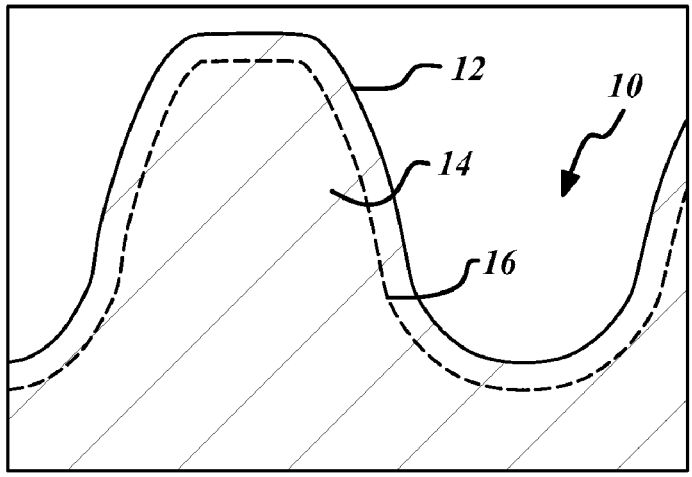
(Prior Art) FIG. 1
FIG. 1 shows a partial cross-sectional view of a case carburized gear.

In all figures, the same reference numerals are used to identify like parts in the various views. Thus, simultaneous reference to the various figures is appropriate. In some instances, for clarity, equivalent parts in different figures may have different item numbers.

Figure 2:
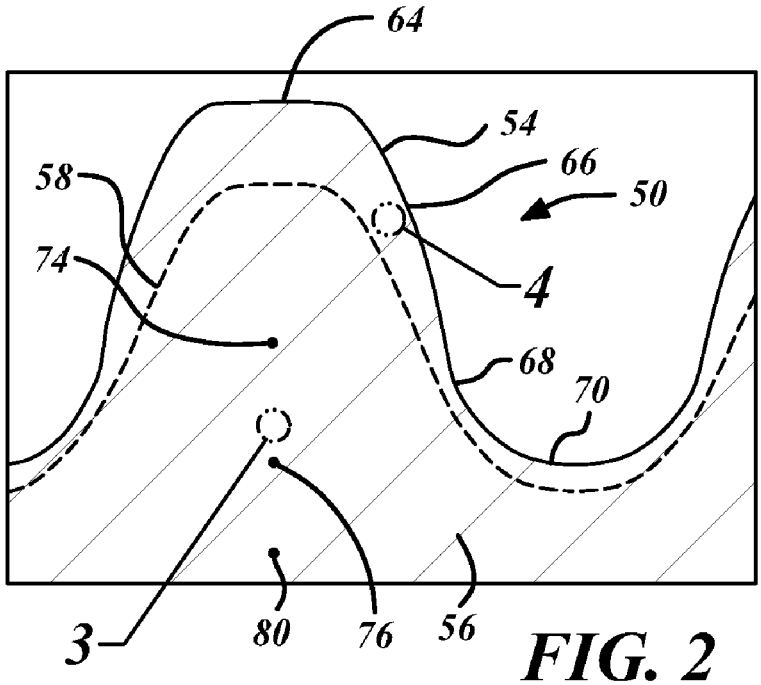
FIG. 2 shows a partial cross-sectional view of a differential side gear having a variable case depth profile used to advantage in accordance with an embodiment of the invention.

FIG. 2 shows a partial cross-sectional view of a differential side gear 50 having a variable case depth profile 58 in accordance with an advantage of the invention. FIG. 7 shows an isometric view of the differential side gear 50 made from the preform 184 of FIG. 6B in accordance with the invention. Before turning to the inventive aspects of obtaining a selectively non-carburized powdered metal part, discussion will first be made of the gear 50 having a variable case depth profile 58 usable to advantage in one aspect of the invention.

The differential side gear 50 includes plurality of teeth 52 and a variable case depth profile 58 formed in a carburized portion of the gear 50. Each tooth of the plurality of teeth 52 has a first surface 54 and a tooth core or root 56. The differential side gear 50 has a rotational axis 60, wherein the teeth 52 extend radially in the same general direction as the rotational axis of the gear, but are inclined with respect to the rotational axis. The differential side gear 50 further includes an axially splined internal section 62 axially aligned with the rotational axis 60. The splined internal section 62 is formed in a noncarburized portion of the gear 50 that was selectively obtained by removing a carburized portion of a preform prior to forging as is discussed herein.

The variable case depth profile 58 is formed in the plurality of teeth 52. The variable case depth profile 58 advantageously provides a gear having greater tooth wear resistance on the first surface 54 and greater impact resistance in the tooth root 56. The variable case depth profile 58 is representative of the effective case depth profile achieved after forging, by carbon diffusion prior to forging the gear. The variable case depth profile 58 resultantly achievable by the forging process is discussed herein.

While a process is described with respect to a differential side gear 50, it is anticipated that the variable case depth profile 58 may be achieved on other parts or gears, including bevel, differential or pinion gears, without limitation.

The differential side gear 50 may be made from a low alloy, fully compacted, ferrous powder metal material. However, it is anticipated that the gear may be made of various other types of forged powder metal steels.

Turning to FIG. 2, the first surface 54 of each tooth of the differential side gear 50 includes a tip surface 64, a pitch line surface 66, a root fillet surface 68 and a rootdiameter or land surface 70. The variable case depth profile 58 is substantially represented by effective case depth of: 2.4 mm at the tip surface 64; 1.9 mm at the pitch line surface 66; 0.4 mm at the root fillet surface 68; and 0.8 mm at the root land surface 70. This results from the carbon diffusion and subsequent forging of a preform. While specific numbers are presented in the present embodiment, it is recognized that the variable case depth may have any non-constant effective case depth profile over a particular surface cross-section and is not limited to the specific profile here presented.

The variable case depth profile 58 may also be represented by a case depth ratio. The effective case depth ratio is given by comparing case depths measured at the tip surface 64 to the root fillet surface 68, the pitch line surface 66 to the root fillet surface 68, or the root land surface 70 to the root fillet surface 68. For example, the variable case depth ratio for the tip surface 64 to the root fillet surface 68 is 6:1, the pitch line surface 66 to the root fillet surface 68 is 19:4, and the root land surface 70 to the root fillet surface 68 is 2:1. A case depth ratio of nearly 1:1 is considered to be within the effective range of a constant case depth 16 of the gear 10 shown in FIG. 1.

Advantageously, the case depth ratio may be 6:1 over the variable case depth profile 58 from the greatest depth to the shallower depth of effective case hardness, thereby achieving greater mechanical properties such as tooth wear and impact resistance.

The tooth root 56 of the gear 50 may include a mid-tooth section 74 having hardness of about 43 HRC, a root section 76 having hardness of about 31 HRC and a core section 78 having hardness of about 32 HRC. While these hardness numbers are only representative of a gear having improved mechanical properties, a core hardness ratio is obtained between the mid-tooth section 74 and the root or core sections 76, 78 of nearly 4 to 3. A higher core hardness ratio is representative of a gear having greater tooth impact resistance, i.e. ductility. Whereas a gear, like the one represented in FIG. 1, would have nearly a 1 to 1 core hardness ratio and thus, less ductility.

Figure 3:
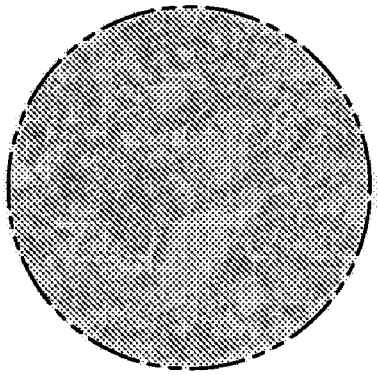
FIG. 3 shows the microstructure below the effective case depth of the gear shown in FIG. 2.
Figure 4:
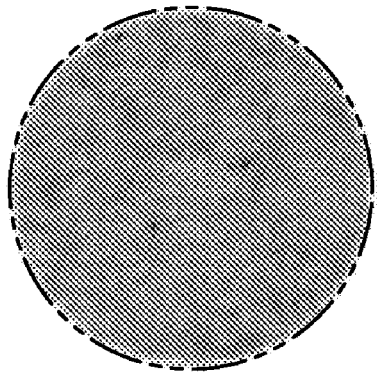
FIG. 4 shows the microstructure within the effective case depth of the gear shown in FIG. 2.

FIG. 3 shows the microstructure below the effective case depth of the gear shown in FIG. 2, and FIG. 4 shows the microstructure within the effective case depth of the gear shown in FIG. 2. The depth boundary is the point where the effective carbon content of the material becomes nearly constant and may be effectively represented by the variable case depth profile 58.

Figure 8:
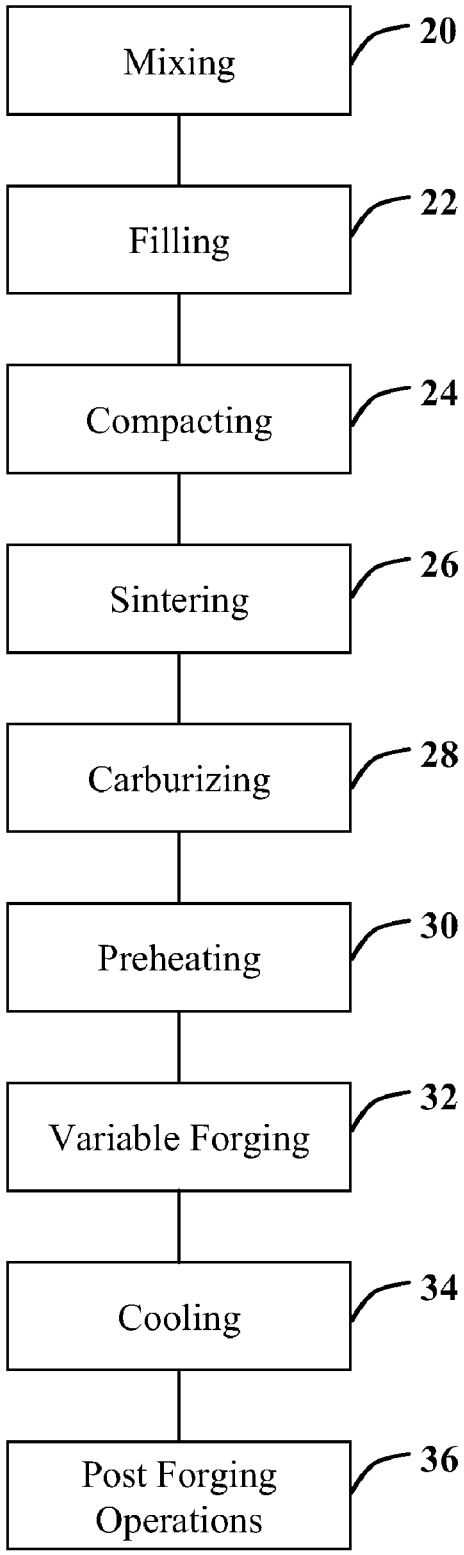
FIG. 8 shows a schematic layout of the process to obtain a variable case depth powder metal gear in accordance with an embodiment of the invention.

Turning to the method of making the powder metal gear with variable case depth, a process is shown in FIG. 8. The process begins with the steps of mixing 20 and continues with some of the possible steps of filling 22, compacting 24, sintering 26, carburizing 28, preheating 30, variable forging 32, and cooling 34. Post forging operations 36 may also be used to further enhance the gear. For brevity, and because some of these process steps are well known to those in the art of forging powder metals, only certain aspects of the inventive process are discussed below. In this regard, material selection, temperature processing and compaction pressures are discussed only briefly.

The mixing step 20 readies the metal powder, including any needed binders or lubricants, by mixing until a nearly uniform mixture is achieved ready for filling into a compacting form during the filing step 22. The compacting step 24 comprises compacting a metal powder into a preform having a nearly uniform initial carbon content throughout the preform. The initial carbon content is achieved by mixing of the metal powder with constituent amounts of graphite together with necessary binders or lubricants to make the preform. The preform includes at least one cross-sectional surface in which the final forged part resultantly obtains a variable case depth profile, as discussed herein.

Figure 5:
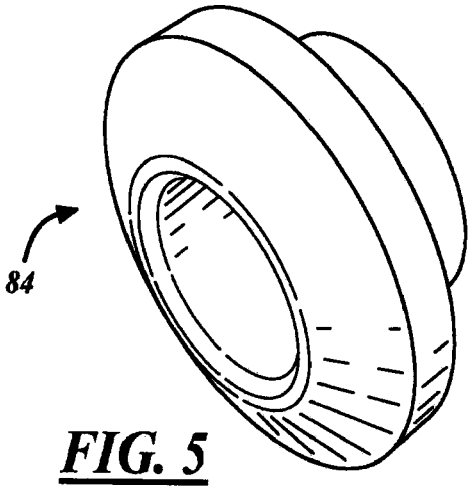
FIG. 5 shows an isometric view of a preform after sintering representative of the inventive aspects of the invention required to obtain the inventive product after forging.

The sintering and carburizing steps 26, 28 may be accomplished simultaneously or the carburizing step may be completed after sintering of the preform. Sintering the preform binds the metal powder. Carburizing the preform substantially increases the initial carbon content in developing a carbon gradient from the surface of the preform into the core. The carbon gradient is produced by providing a controlled carbon atmosphere and maintaining the preform in the controlled atmosphere for a predetermined period of time. It is necessary to obtain a substantially constant carbon case depth in the preform in order to enhance critical flow of metal during forging for achieving the desired variable case depth profile in the post forged part. Of course, density gradient, part geometry and carburizing conditions dictate the uniformity of the carburizing process. The case depth of carbon necessary in the preform is determined by the preform geometry and the desired areas of critical metal flow during forging. To achieve the variable case depth profile in gear 50 mentioned above as measured by the ratios presented, the preform is carburized to a case depth of ¼ the tooth height, but may also be satisfied by carburizing to a case depth of 1/20 the tooth height or to ⅞ the tooth height. It is anticipated that too little case depth in the preform may result in non-carburized areas. It is also anticipated that too much case depth in the preform may result in a nearly constant case depth profile. FIG. 6A shows a partial cross-sectional view of the carburized preform 85 of the representative preform 84 of FIG. 5 after carburization process. The preform 85 has substantially constant carbon case depth 86 achieved after sintering and carburizing the preform.

The variable forging step 32 comprises forging the carburized preform at a forge temperature and a forge pressure to obtain a substantially dense, net shape, part. The variable case depth profile for the gear results in nearly symmetrical profiles for each tooth because of the symmetrical nature of the forging dies and the carburized preform. However, it is recognized that different carburization schemes and forging steps may be used to obtain multiple variable case depth profiles.

The variable case depth profile is achieved by utilizing a die set of the forge to variably enhance critical flow of the carburized metal portion during the forging process. Essentially, the constant case depth of the carburized powder metal preform is strategically compressed into the die sections, wherein portions of the preform are stretched and thinned during forging and other portions of the preform are thickened and deepened with the carburized powder metal. Again, case depth that is too shallow or too deep in the carburized powder metal preform prior to forging will not produce the variable case depth profile in the final product.

The cooling step 34 allows the forged part to obtain a particular metallurgy resulting in a gear having the desired variable case depth profile. Cooling of the forged part may be by quenching in oil, water, air or by other methods suitable to the powder metal forging process.

Prior to cooling, including a dwelling step of the forged part for a dwell period may allow for enhanced properties by allowing temperature stabilization of the material of the part.

The optional preheating step of the preform to a pre-forge temperature prior to forging may enhance the desired metal flow during the forging process.

Optional post forging operations step 36 may include, turning, facing, surface grinding, splining, and broaching of the product depending upon final specification requirements, thereby being ready for washing, packing, or shipping.

With proper selection and combinations of powder metal, compaction dies, processing times, processing temperatures, processing pressures, forging dies, and cooling method a near net shape, fully dense product may be obtained having the variable case depth profile, thereby requiring minimal if any machining operations facilitating cost savings and performance improvements.

Figure 9:
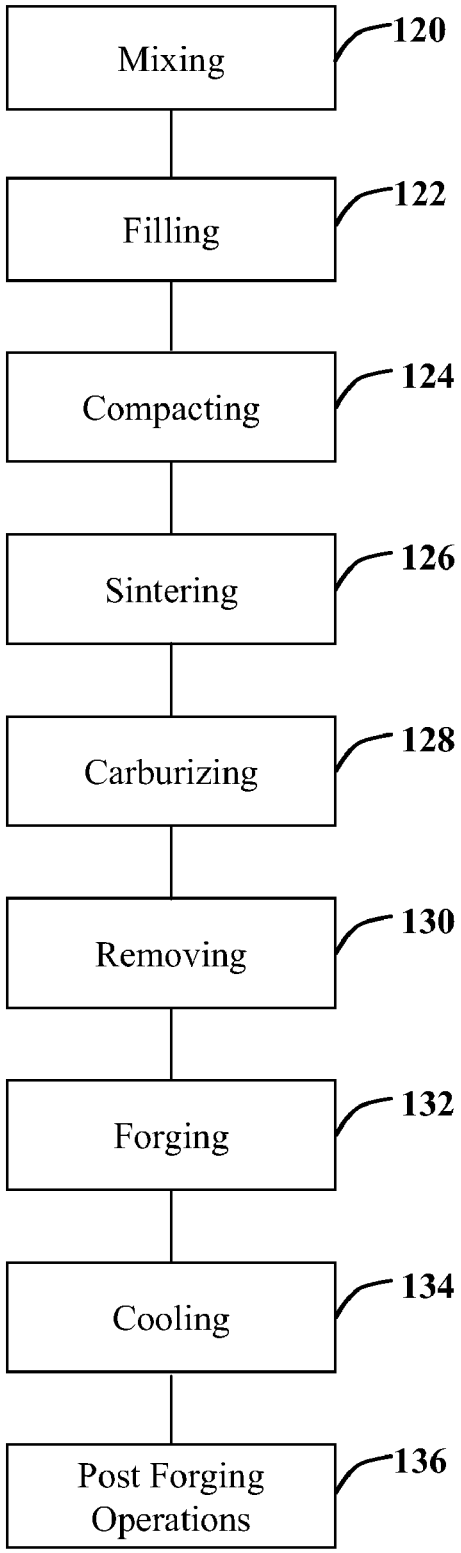
FIG. 9 shows a schematic layout of an embodiment of a process according to the invention to obtain a forged carburized powder metal part.

Turning to the inventive method of making a forged carburized powder metal part, an embodiment of a process is shown in FIG. 9. The process begins with the steps of mixing 120 and continues with the steps of filling 122, compacting 124, sintering 126, carburizing 128, removing 130, forging 132, and again ending with cooling 134. Post forging operations 136 may also be used to further enhance the gear. Compatible processing steps mentioned above in regards to the process shown in FIG. 8 that are also compatible to the current method of FIG. 9 may also be used to further enhance the powdered metal part. For brevity, and because some of these process steps are well known to those in the art of forging powder metals, only certain aspects of the invention are primarily discussed below.

Figure 6B:
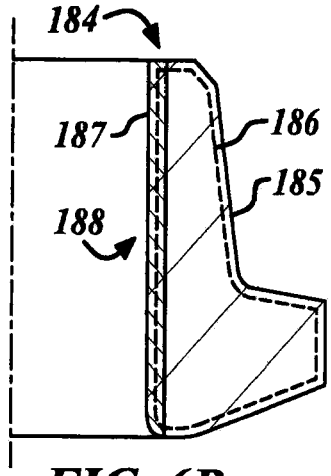
FIG. 6B shows a partial cross-sectional view of a carburized portion to be removed from the preform of FIG. 6A by a removing process prior to forging.
Figure 6A:
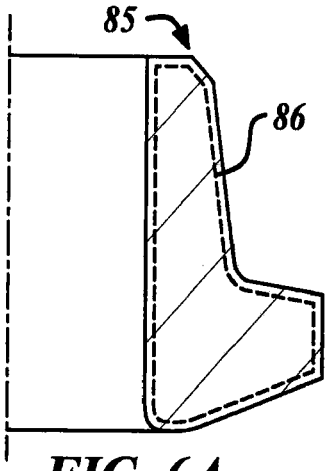
FIG. 6A shows a partial cross-sectional view of the representative preform of FIG. 5 after carburization.
Figure 7:
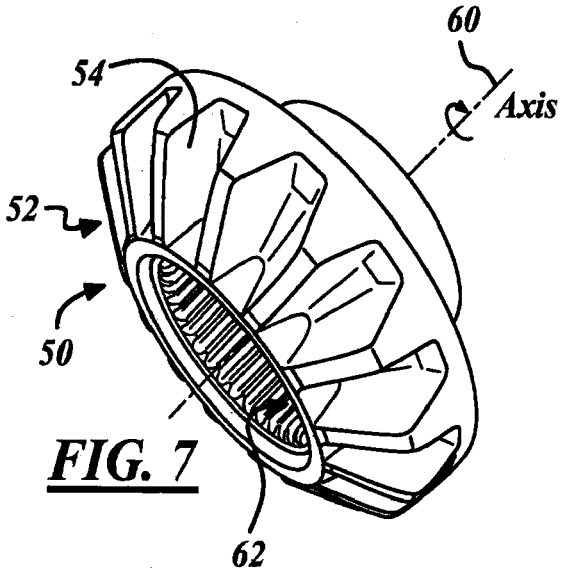
FIG. 7 shows an isometric view of the differential side gear made from the preform of FIG. 6B in accordance with an embodiment of the invention.

For a proper appreciation of the process of FIG. 9, attention is directed momentarily to the preform 184 of FIG. 6B. FIG. 6B shows a partial cross-sectional view of a carburized portion 188 to be removed from the preform 85 of FIG. 6A by a removing process prior to forging. FIG. 6A shows a partial cross-sectional view of the representative preform 84 of FIG. 5 after carburization. The preform 184 includes at least one first surface 185, a case depth 186, at least one second surface 187, and a carburized portion 188. The carburized portion 188 is selectively chosen to be removed from the preform prior to forging. By selectively removing the carburized portion prior to forging results in a final part having superior machining capabilities for secondary operations thereby obtaining, for instance, higher spline classification or tighter broaching tolerances in the relatively soft non-carburized material. Additional benefit is further derived from the strategically improved carburized portion resultantly obtained during the sint-carb and forging processes.

Returning to the process of FIG. 9, a selectively non-carburized powdered metal part requires a compacting step of a metal powder into a preform.

The simultaneous or subsequent steps of sintering and carburizing, or sintering and then carburizing the preform to obtain preform 184 may be accomplished with the sintering and carburizing processes mentioned above.

As is known in the art, a typical sintering temperature for steel metal powder is from about 2000.degree. F. to 2100.degree. F. while the initial carbon content of the preform may be less than 0.22% by weight. By carburizing, a final carbon content in the at least one first surface may be in the range of 0.22% to 0.37% by weight.

The step of removing the carburized portion on the at least one second surface of the preform is performed prior to forging. Removing at least one carburized portion advantageously results in a forged part having a carburized portion on at least one first surface with its beneficial case hardness while at the same time providing at least one second surface in which the material is not case hardened. The removing step allows for the strategic removal of the carburized portion 188 of the second surface 187 from the sintered preform prior to forging. The removal process may be done with known methods, such as punching, machining, or grinding, for example. One advantage to removing the carburized portion is that it avoids the need for complex and complicated masking and unmasking operations to control the diffusion of carbon during the sint-carb processes. Another added advantage to removing the carburized portion in the sintered preform during its relatively soft state is improved tool life thereby obtaining higher performance characteristic for items such as spline classification. Moreover, typically the splining operation is completed when the part is considered to be in its hard state after forging causing unnecessary tool wear and reduced spline tolerance or performance.

The forging and cooling steps are then completed to obtain the part having at least one second surface having shear resistance properties and at least one first surface having surface hardness properties. Forging and cooling may be done in accordance with accepted methods known to those in the art of powder metal forging, typically being at a temperature for steel powder metal being from about 1600.degree.F. to 1800.degree.F. It is also desirable to obtain a substantially fully dense part having at least 99.6% of theoretical density by applying a forging pressure typically ranging between 50 and 70 tons per inch.

If a final part is to be near-net shape after forging, the material being removed during the removing step should be accounted for in the compaction step by making an appropriate or oversize preform.

The process as given in FIG. 9 may also advantageously utilize the variable forging step as given in the process of FIG. 8. Specifically, a variable case depth profile may be achieved in the final part during forging of the carburized portion of the at least one first surface of the preform after the removing step. In this instance, if the part is a gear made in accordance with this invention, then it may have the variable case depth profile as represented in FIG. 2, while simultaneously having the preferable soft internal diameter required for greater spline class and shear strength.

The part made in accordance with the inventive process of FIG. 9 may include any part having required hard and soft surfaces. Specifically, the inventive process of FIG. 9 is particularly advantageous for a toothed gear.

While various process steps have been presented, they are intended only to be limited in scope or order as indicated in the claims of this invention. Further, while the invention has been described in connection with several embodiments, it should be understood that the invention is not limited to those embodiments. Thus, the invention covers all alternatives, modifications, and equivalents as may be included in the spirit and scope of the appended claims.

What is claimed is:

1. A method for obtaining a selectively non-carburized powder metal part comprising the sequential steps of:

compacting a metal powder into a preform, said preform having at least one first surface and at least one second surface;

sintering and carburizing, sequentially or simultaneously, said preform to provide a substantially constant case depth across the at least one first surface and the at least one second surface;

removing a carburized portion on the at least one second surface of the preform in a pre-forge machine zone prior to forging of the preform;

forging said preform to obtain a forged part having a changed shape formed during forging in the pre-forge machine zone on the at least one second surface; and cooling said forged part.

2. The method of claim 1 wherein said forged part is cooled by quenching in an oil bath after forging and temperature stabilization.

3. The method of claim 1 wherein sintering is at a temperature from about 2000° F. to 2100° F.

4. The method of claim 1 wherein said powder metal results in said preform having a substantially uniform initial carbon content throughout.

5. The method of claim 1 comprising carburizing said preform to substantially increase carbon content in said preform by providing a controlled carbon atmosphere and maintaining said preform in said controlled carbon atmosphere for a predetermined period sufficient to obtain a desired case depth of the at least one first surface of the forged part being greater than said initial carbon content.

6. The method of claim 5 wherein said initial carbon content of said preform is less than 0.22% by weight and wherein final carbon content of the at least one first surface with said carburized portion is in the range of 0.22% to 0.37% by weight.

7. The method of claim 1 wherein forging is at a temperature from about 1600° F. to 1800° F. to a density of at least 99.6% of theoretical density to obtain said forged part.

8. The method of claim 1 wherein removing the carburized portion on the at least one second surface of the preform is by soft turning or broaching.

9. The method of claim 1 wherein the preform is oversized to compensate for the material to be removed during removing, thereby resulting in a near-net shape part after forging.

10. The method of claim 1 wherein said final forged part is near net shape.

11. The method of claim 1, further comprising cleaning after cooling.

12. The method of claim 1, further comprising hard turning after cooling.

13. The method of claim 1 wherein said metal powder is a low alloy ferrous metal powder.

14. The method of claim 1 wherein forging said preform to obtain said forged part having a variable case depth profile of said at least one first surface, wherein said variable case depth profile is achieved by utilizing a die set of said forge to variably enhance critical flow of said carburized portion of metal to form a plurality of gear teeth while forging said forged part such that a case depth at a tip of at least one of the gear teeth exceeds a case depth at a corresponding root.

15. The method of claim 1, wherein the at least one second surface of the preform is a portion of a spline surface and wherein the changed shape formed by forging the preform is axially-extending splines in the spline surface.

16. A method for providing a gear having a selectively non-carburized powder metal portion comprising the sequential steps of:

compacting a metal powder into a preform, said preform having at least one gear surface defining a case depth hardness surface, and said preform having at least one spline surface with a carburized portion to be removed prior to forging;

sintering and carburizing, sequentially or simultaneously, said preform;

turning or broaching to remove said carburized portion in a pre-forge machine zone on said at least one spline surface of the preform;

forging said preform to form splines in the pre-forge machine zone on the at least one spline surface and to obtain a forged part; and cooling said forged part, wherein said forged part has at least one spline surface having shear resistance properties and at least one gear surface having surface hardness properties.

17. The method of claim 16 comprising forging said preform to obtain said forged part having a variable case depth profile of said at least one gear surface having a plurality of gear teeth in which a case depth at the tip of at least one of the gear teeth exceeds a case depth at a corresponding root.

* * * * *